United States Patent [19]

Rosendall

[11] 4,124,913

[45] Nov. 14, 1978

[54] FLOOR SWEEPER WITH UNITARY FRAME

[75] Inventor: Henry J. Rosendall, Grand Rapids, Mich.

[73] Assignee: Bissell, Inc., Grand Rapids, Mich.

[21] Appl. No.: 811,242

[22] Filed: Jun. 29, 1977

[51] Int. Cl.[2] ..... A47L 11/33

[52] U.S. Cl. ..... 15/42; 15/48

[58] Field of Search ..... 15/41–48

[56] References Cited

U.S. PATENT DOCUMENTS

| | | | |
|---|---|---|---|
| 186,895 | 1/1877 | Stewart | 15/41 R |
| 2,962,740 | 12/1960 | Plantholt | 15/41 R |
| 2,975,449 | 3/1961 | Liddell et al. | 15/41 R |
| 3,268,936 | 8/1966 | Fukuba | 15/42 X |
| 4,028,765 | 6/1977 | Liebscher | 15/42 |

FOREIGN PATENT DOCUMENTS

| | | | |
|---|---|---|---|
| 620,821 | 3/1949 | United Kingdom | 15/41 R |

*Primary Examiner*—Edward L. Roberts

*Attorney, Agent, or Firm*—Andrus, Sceales, Starke & Sawall

[57] ABSTRACT

A unitary top-less peripheral frame is provided which holds substantially all the functional parts of the sweeper. The frame includes end walls carrying bearings which receive the ends of the brush roller shaft, with the said end walls being spring-like and flexible to permit easy insertion and removal of the shaft. The frame has brush bristle tufts mounted therein at the corners. A separate top is removably mounted to the peripheral frame, with the top carrying bail detent or stop elements which additionally extend downwardly and lock the top to the unitary frame while also holding the dust pan springs in place. The front and/or rear frame walls which extend between the said end walls form a debris-retaining wall. The frame provides a lip which is engageable by the pan edge and which seals the pan chamber and tends to increase the frictional forces between the sweeper wheels and the brush roller element.

19 Claims, 6 Drawing Figures

Fig. 3
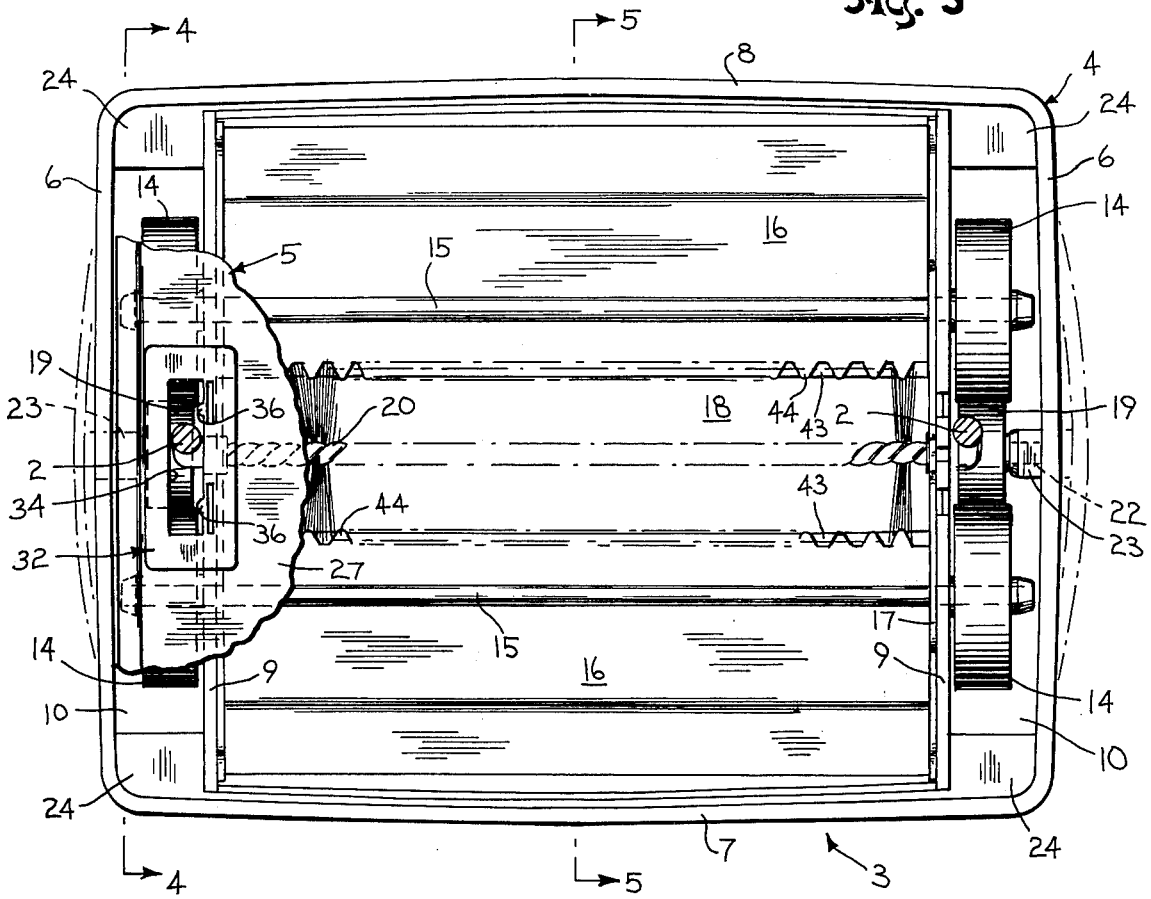
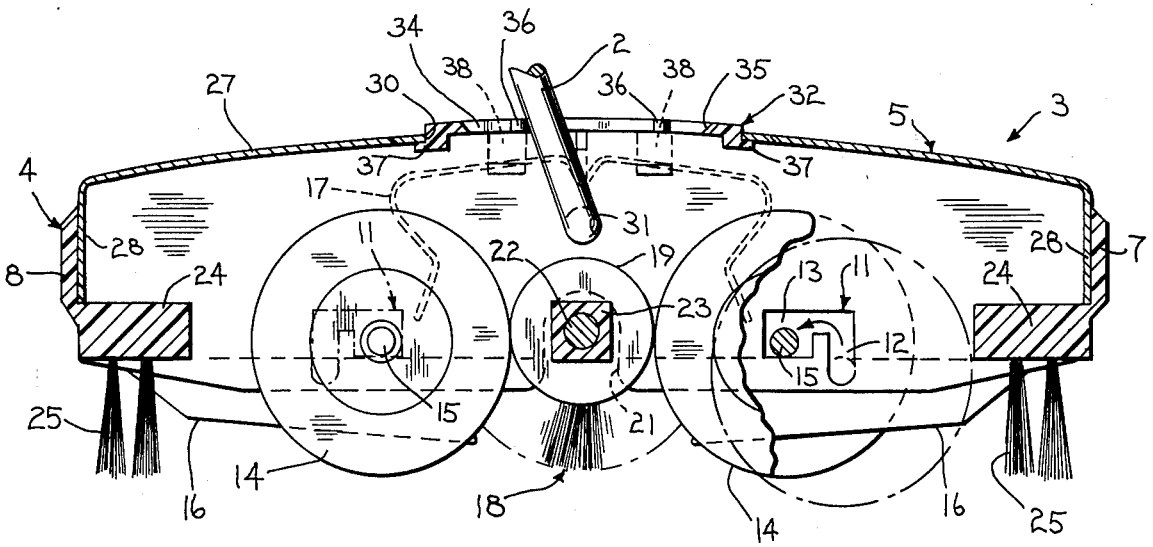
Fig. 4

FLOOR SWEEPER WITH UNITARY FRAME

BACKGROUND OF THE INVENTION

This invention relates to a floor sweeper with a unitary frame.

It is already known to provide a floor sweeper with at least one rotatable brush roller and an adjacent dust pan, and wherein the brush roller is mounted in end bearings for sweeping debris into the pan. It is also already known to construct the dust pan with a bottom, end walls and a rear wall and to mount the pan for pivoting on the axles of the sweeper wheels. Furthermore, sweepers are known which include a mounting device for the wheels, brush roller and bail, with said mounting device disposed inwardly of the peripheral sweeper frame. It is also known to dispose the sweeper wheels in engagement with the roller brush so that the former rotatably drives the latter as the sweeper is translated back and forth over the floor.

SUMMARY OF THE INVENTION

It is the task of the present invention to provide a simpler and more economical floor sweeper structure wherein the brush roller can be easily removably mounted to the peripheral sweeper frame itself. It is a further task to eliminate the need for a rear dust pan wall, and to improve the driving engagement of the sweeper wheels with the brush roller. An additional task is to provide a sweeper top which is easily separable from the said peripheral frame and which includes a bail detent or stop device which also functions to lock the top to the frame disposed therebeneath. The result created by the above is a floor sweeper which is economical to manufacture, repair, assemble and disassemble.

In accordance with one aspect of the invention, a unitary top-less peripheral frame is provided which holds substantially all the functional parts of the sweeper. The frame includes end walls carrying bearings which receive the ends of the brush roller shaft, with the said end walls being spring-like and flexible to permit easy insertion and removal of the shaft. The frame has brush bristle tufts mounted therein at the corners.

In accordance with another aspect of the invention, a separate top is removably mounted to the peripheral frame, with the top carrying bail detent or stop elements which additionally extend downwardly and lock the top to the unitary frame while also holding the dust pan springs in place.

In accordance with still another aspect of the invention, the front and/or rear frame walls which extend between the said end walls, form a debris-retaining wall which eliminates the need for a dust pan to have its own rear wall. In addition, the frame provides a lip which is engageable by the pan edge and which seals the pan chamber and tends to increase the frictional forces between the sweeper wheels and the brush roller element.

BRIEF DESCRIPTION OF THE DRAWINGS

The accompanying drawings illustrate the best mode presently contemplated by the inventor for carrying out the invention.

In the drawings:

FIG. 3 is a top plan view of the sweeper with a substantial portion of the top removed for purposes of clarity, and with parts in section;

FIG. 4 is a section taken on line 4—4 of FIG. 3;

DESCRIPTION OF THE PREFERRED EMBODIMENT

Figure 1:
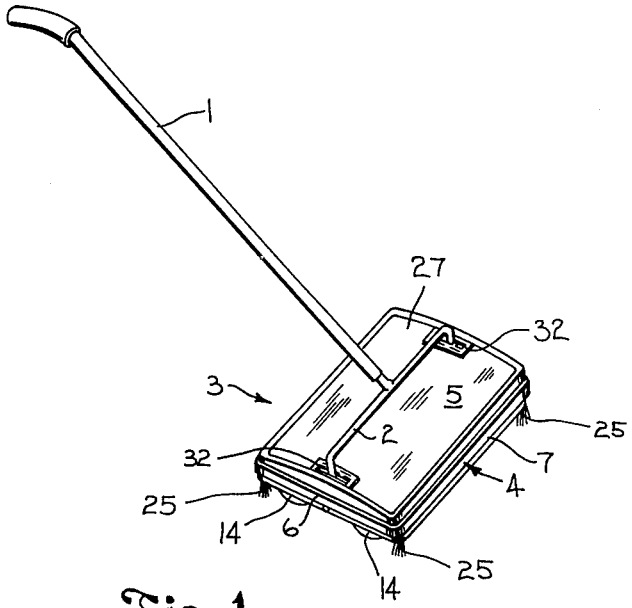
FIG. 1 is a perspective view of a floor sweeper embodying the concepts of the invention.

As shown in the drawings, the sweeper of the invention includes the usual handle 1, bail 2 and lower sweeping unit 3. Unit 3 primarily comprises a rectangular unitary frame 4 constructed of molded plastic or the like, and a removable top 5 of any suitable material such as metal.

Frame 4 is adapted to mount substantially all of the functional working parts of the sweeper. For this purpose, the frame comprises a narrow peripheral strip which forms end walls 6, a front side wall 7 and a rear side wall 8. A partition 9 is spaced inwardly from each end wall 6 and extends parallel thereto and slightly downwardly beyond the wall terminus, forming a recess 10. Partitions 9 each have a pair of generally L-shaped slots 11 therein, with each slot having a vertical leg 12 and a connecting horizontal leg 13. During assembly of the sweeper parts, a pair of running wheels 14 are placed in opposed recesses, and an axle 15 is passed through the wheels and the lowermost end of vertical slot legs 12. The wheel-axle assembly is then pressed into the opposed slots until the axle ends are disposed in horizontal slot legs 13, as shown in FIG. 4. Legs 13 permit lateral movement of the pan assemblies in both directions.

Two wheel-axle assemblies are mounted in spaced relation on partitions 9. These assemblies are adapted to each carry a dust pan 16 which is mounted for rotation on the respective axle 15 between partitions 9. A pair of unitary springs 17 connect the ends of the spaced pans to bias them from an open emptying position toward a normally closed position.

An elongated brush roller 18 is adapted to be disposed between and rotatably driven by sweeper wheels 14. For this purpose, brush roller 18 includes end mounted coupling wheels 19 which are adapted to be disposed in recess 10 between and in engagement with wheels 14. The brush roller includes a shaft 20 which is receivable in slots 21 in partitions 9, with the shaft having end portions 22 extending outwardly from coupling wheels 19.

In accordance with one aspect of the invention, shaft 20 is journalled in end bearings 23 which are mounted directly to the opposed end walls 6 of frame 4 and which, as shown, extend slightly inwardly thereof. For purposes of assembly and removal of brush roller 18 from the frame, end walls 6 are themselves flexible and form spring elements which can be manually displaced outwardly at their mid-sections, as best shown in phantom lines in FIGS. 2 and 3. The inward biasing action of walls 6 serves to hold brush roller 18 in place.

Figure 2:
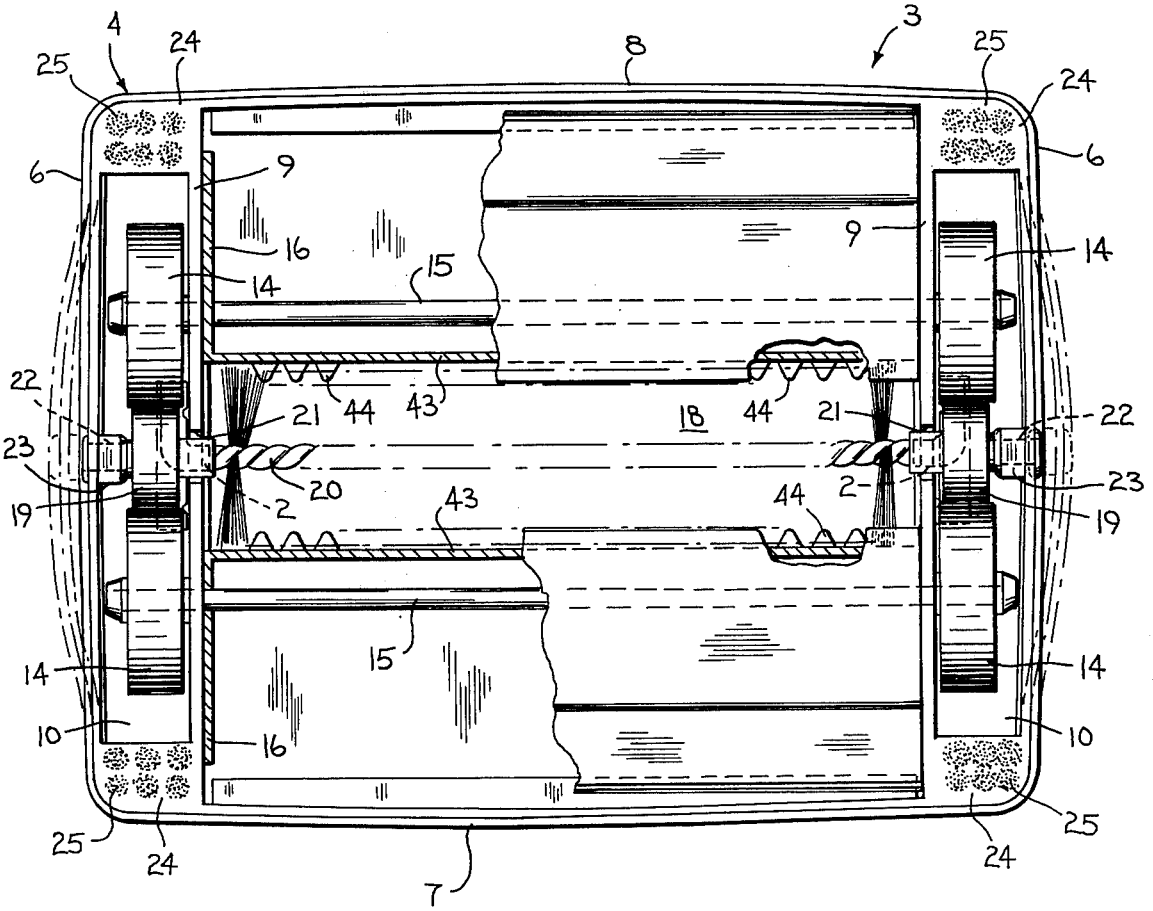
FIG. 2 is a bottom plan view of the sweeper, with parts broken away and in section.

As best shown in FIGS. 2 and 4, unitary frame 4 is provided at its interior corners with thickened base members 24 which have openings therein for anchoring a plurality of downwardly extending floor engaging brush bristle tufts 25. Thus the frame itself supports fixed corner brush bristles disposed fore and aft of sweeper wheels 14.

Figure 5:
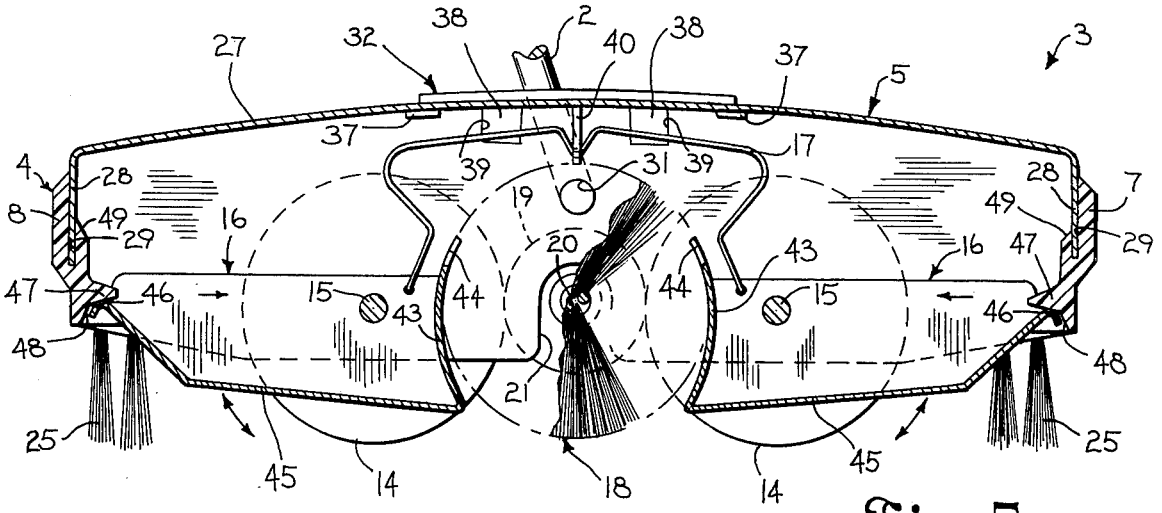
FIG. 5 is a section taken on line 5—5 of FIG. 3.

In accordance with another aspect of the invention, a separate sweeper top 5 is provided with the top having a slightly curved upper wall 27, the outer periphery of which is formed to create edge flanges 28 which extend downwardly within frame 4. Referring to FIG. 5, front and rear walls 7 and 8 of frame 4 are slotted, as at 29, to receive the edges of the respective top flanges 28 for alignment purposes.

A pair of spaced slots 30 are disposed in top 5 and the arms of bail 2 extend downwardly therethrough and are mounted in openings 31 in partitions 9.

Figure 6:
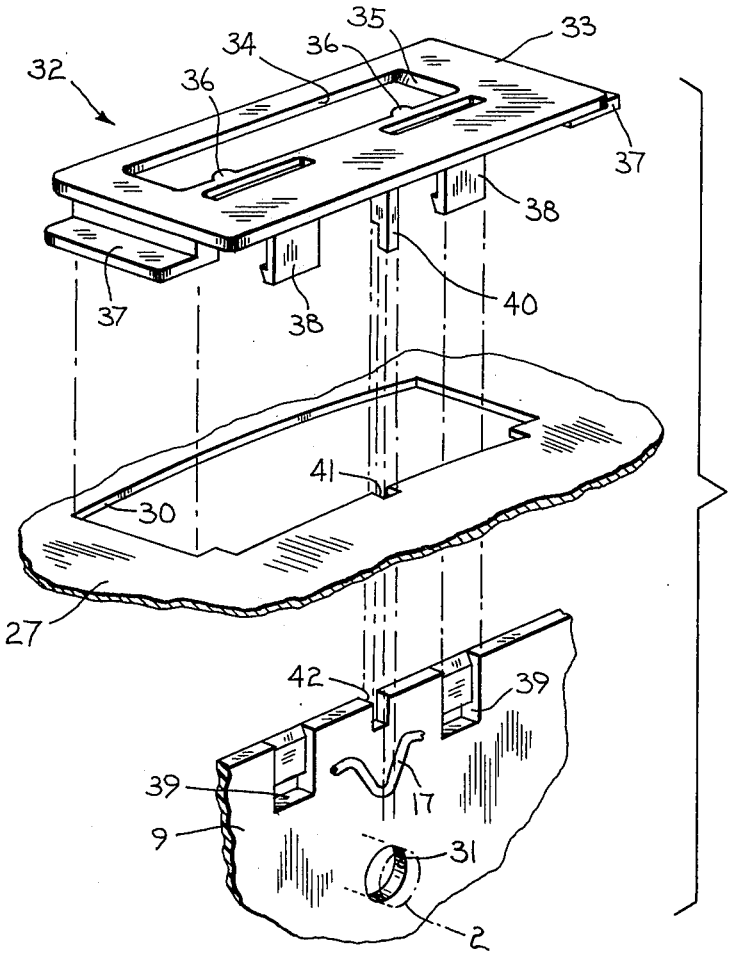
FIG. 6 is an enlarged exploded view of the bail stop, showing its connectability to the top and the frame.

Referring particularly to FIGS. 4–6, means are provided on top 5 in association with slots 30 to stop and hold bail 2 in a desired position, with said means also cooperating with frame 4 to lock the top to the latter and to retain the dust pan springs 17 in place. For this purpose, a bail stay 32 of plastic or the like is removably disposed in each slot 30. Stay 32 includes a generally planular body 33 having an elongated slot 34 with end stop edges 35 and detents 36 for bail positioning. End flanges 37 on body 33 are adapted to extend outwardly and beneath top 5 to hold the bail stay in place. Body 33 is slightly flexible and may be bent so that it is shortened until it can be inserted in the respective top slot 30. Upon release of body 33, it will recover its shape and spring back to the holding position shown in FIGS. 4 and 5.

As best shown in FIG. 6, a pair of spaced springable latch arms 38 extend downwardly from body 33 and are adapted to lockingly engage notches 39 formed in the respective frame portion 9 to hold the top and frame together. In addition, a retainer arm 40 extends downwardly from body 33 through a notch 41 in the edge of top slot 30 and is received in a notch or groove 42 in the edge of partition 9 between locking notches 39. The lower end of each arm 40 forms a holding retainer for the central portion of the respective dust pan spring 17. See FIG. 4.

As best shown in FIGS. 2 and 5, each dust pan 16 is provided with an upstanding inner wall 43 having the usual brush engaging teeth 44 thereon, and a bottom wall 45 which angles upwardly and outwardly and terminates in a curved edge 46 adjacent the respective front or rear frame wall.

In accordance with still another aspect of the invention, cooperative means are provided to seal each pan edge 46 to the frame and to bias the pan inwardly to thereby increase the frictional engagement of the sweeper wheels 14 with brush coupling wheels 19. In addition, the respective front and rear frame walls 7 and 8 serve as upper extensions of the back pan walls, thus eliminating the need for the pans to have their own high walls.

For this purpose, frame walls 7 and 8 are each provided with an inwardly extending lip 47 which each pan edge portion 46 is biased upwardly against by springs 17 to create a sealing engagement. The lower surface of each lip 47 has a portion which is tapered upwardly and inwardly as at 48 which, when it is engaged by pan edge 46, forces the pan inwardly, so that axle 15 shifts in slot leg 13 and wheels 14 are biased against coupling wheels 19 to tighten the engagement therebetween.

Furthermore, frame portions 7 and 8 extend upwardly from lips 47, as at 49 to effectively form an inner wall for the dust pan chamber.

The sweeper of the invention has been found to be an improvement over prior sweepers in that it is economical to manufacture and maintain.

Although one brush roller and two dust pans have been illustrated and described in the present embodiment, any other suitable number of brush rollers and dust pans may be utilized without departing from the spirit of the invention.

Various modes of carrying out the invention are contemplated as being within the scope of the following claims particularly pointing out and distinctly claiming the subject matter which is regarded as the invention.

I claim:

1. In a floor sweeper having a handle and a bail attached to said handle, a lower sweeping unit attached to said bail and comprising:

(a) a unitary frame having a peripheral portion defining the end walls and the front and rear side walls of the lower sweeper unit, (b) a dust pan assembly including a dust pan pivotally mounted on an axle disposed for shifting movement on said frame, with said axle having sweeper wheels disposed thereon.

(c) a brush roller including a shaft with coupling wheels disposed to be drivingly engaged by said sweeper wheels, (d) bearing means on said frame end walls for journaling the ends of said brush roller shaft, (e) and said frame end walls themselves forming outwardly displaceable spring means for holding said brush roller and its shaft in place.

2. The floor sweeper of claim 1 wherein:

(a) said unitary frame includes a plurality of base members disposed at the frame corners between the walls thereof, (b) and downwardly extending floor engaging brush bristle tufts fixedly anchored in said base members.

3. In the floor sweeper of claim :

(a) a terminal edge on said dust pan and with said edge normally being disposed adjacent one of said frame side walls, (b) spring means biasing said dust pan from an open position toward a closed position, (c) and lip means on said one of said frame side walls for sealingly receiving said pan edge when the pan is biased into closed position.

4. The floor sweeper of claim which includes means disposed on said one of said frame side walls and responsive to closing of said dust pan to bias said sweeper wheels against said coupling wheels.

5. The floor sweeper of claim 4 wherein said last-named biasing means comprises an upwardly and inwardly extending lower lip surface which is engaged by said dust pan edge when the pan is in closed position to bias said dust pan assembly toward said coupling wheels.

6. The floor sweeper of claim 5 wherein said one of said frame side walls extends upwardly from said lip to effectively form a wall for the dust pan chamber.

7. In the floor sweeper of claim 3:

(a) a top for said lower sweeper unit with said top having an upper surface and downwardly extending peripheral flanges for engaging the peripheral portion of said frame, (b) said top having a pair of slots for receiving the said bail therethrough, (c) a bail stay disposed in each said slot, (d) and locking means connecting said bail stay and said frame for securing said top to said frame.

8. The floor sweeper of claim 7 wherein said locking means coprises:

(a) latch arm means extending downwardly from said bail stay, (b) and notch means disposed in said frame for receiving said latch arm means.

9. The floor sweeper of claim 8:

(a) wherein said frame includes a partition disposed inwardly from the peripheral portion of the sweeper frame, (b) said notch means being disposed in said partition.

10. In the floor sweeper of claim 7: retainer means extending between said bail stay and said frame for holding said dust pan biasing spring means in place.

11. In the floor sweeper of claim 1:

(a) a top for said lower sweeper unit with said top having an upper surface and downwardly extending peripheral flanges for engaging the peripheral portion of said frame, (b) said top having a pair of slots for receiving the said bail therethrough, (c) a bail stay disposed in each said slot, (d) and locking means connecting said bail stay and said frame for securing said top to said frame.

12. In a floor sweeper:

(a) a generally rectangular frame having a peripheral portion defining the end walls and the front and rear side walls of the sweeper, (b) a dust pan assembly including a dust pan pivotally mounted on an axle, with said axle having sweeper wheels disposed thereon, (c) a terminal edge on said dust pan and with said edge normally being disposed adjacent one of said frame side walls, (d) spring means biasing said dust pan from an open position toward a closed position, (e) a brush roller including a shaft with coupling wheels disposed to be drivingly engaged by said sweeper wheels, (f) and means disposed on said one of said frame side walls and responsive to closing of said dust pan to bias said sweeper wheels against said coupling wheels.

13. The floor sweeper of claim 12 which includes means mounting said dust pan assembly for movement toward and away from said coupling wheels, and wherein said last-named biasing means comprises an upwardly and inwardly extending lower surface which is engaged by said dust pan edge when the pan is in closed position to bias said dust pan assembly toward said coupling wheels.

14. The floor sweeper of claim 13 wherein said one of said frame side walls extends upwardly from said lip to effectively form a wall for the dust pan chamber.

15. In a floor sweeper having a handle, a bail attached to said handle, and a lower sweeping unit attached to said bail:

(a) a frame having a peripheral portion defining the walls of the lower sweeper unit, (b) a top for said lower sweeper unit and with said top having a pair of slots for receiving the said bail therethrough, (c) a bail stay disposed in each said slot, (d) and locking means connecting said bail stay and said frame for securing said top to said frame.

16. The floor sweeper of claim 15 wherein said locking means comprises:

(a) latch arm means extending downwardly from said bail stay, (b) and notch means disposed in said frame for receiving said latch arm means.

17. In the floor sweeper of claim 15.

(a) a pivotal dust pan disposed beneath said top, (b) spring means biasing said dust pan from an open position toward a closed position, (c) and retainer means extending between said bail stay and said frame for holding said spring means in place.

18. In a floor sweeper having a handle, a bail attached to said handle, and a lower sweeping unit attached to said bail:

(a) a frame having a peripheral portion defining the walls of the lower sweeper unit, (b) a top for said lower sweeper unit and with said top having a pair of slots for receiving the said bail therethrough, (c) a bail stay disposed in each said slot, (d) a pivotal dust pan disposed beneath said top, (e) spring means biasing said dust pan from an open position toward a closed position, (f) and retainer means extending between each said bail stay and said frame for holding said spring means in place.

19. In a floor sweeper:

(a) a generally rectangular frame having a peripheral portion defining the end walls and the front and rear side walls of the sweeper, (b) a dust pan assembly including a dust pan pivotally mounted on an axle, with said axle having sweeper wheels thereon, (c) a terminal edge on said dust pan and with said edge normally being disposed adjacent one of said frame side walls, (d) a brush roller including a shaft with coupling wheels disposed to be drivingly engaged by said sweeper wheels, (e) means mounting said dust pan assembly for movement toward and away from said coupling wheels, (f) means biasing said dust pan from an open position toward a closed position, (g) and an upwardly and inwardly extending surface on said frame, said surface being engaged by said dust pan edge when the pan is in closed position.

* * * * *

UNITED STATES PATENT AND TRADEMARK OFFICE

CERTIFICATE OF CORRECTION

PATENT NO. : 4,124,913

DATED : November 14, 1978

INVENTOR(S) : Henry J. Rosendall

It is certified that error appears in the above-identified patent and that said Letters Patent are hereby corrected as shown below:

Column 4, Line 39, After "claim" insert ---1---

Column 4, Line 48, After "claim" insert ---3---

Column 6, Line 59, After "position" insert ---to bias said dust pan assembly toward said coupling wheels---

Signed and Sealed this

*Thirteenth* Day of *March 1979*

[SEAL]

*Attest:*

RUTH C. MASON
*Attesting Officer*

DONALD W. BANNER
*Commissioner of Patents and Trademarks*